US005144200A

United States Patent [19]

Kim

[11] Patent Number: 5,144,200

[45] Date of Patent: Sep. 1, 1992

[54] PLASMA DISPLAY PANEL AND MANUFACTURING METHOD THEREOF

[75] Inventor: Dae-il Kim, Kyunggi, Rep. of Korea

[73] Assignee: Samsung Electron Devices Co., Ltd., Rep. of Korea

[21] Appl. No.: 705,562

[22] Filed: May 24, 1991

[30] Foreign Application Priority Data

May 25, 1990 [KR] Rep. of Korea ..... 90-7604

[51] Int. Cl.[5] ..... H01J 17/49

[52] U.S. Cl. ..... 313/584; 313/585; 313/590; 445/24

[58] Field of Search ..... 313/584, 585, 590, 618, 313/619, 632, 582; 445/24, 25, 49

[56] References Cited

U.S. PATENT DOCUMENTS 5,032,768 7/1991 Lee et al. ..... 313/584

*Primary Examiner*—Palmer C. DeMeo
*Assistant Examiner*—Diab Hamadi
*Attorney, Agent, or Firm*—Leydig, Voit & Mayer

[57] ABSTRACT

A plasma display panel comprises two substrates and a plurality of striped anodes and cathodes arranged on the substrate in X/Y matrix form. A method of manufacturing the PDP comprises the consecutive steps of forming a plurality of striped first cathode elements, forming a plurality of insulating wall bodies, an completing the cathode units. The PDP has a much higher cathode current than the conventional PDPs and realizes a pictorial image of uniform luminance throughout the whole screen.

12 Claims, 3 Drawing Sheets

PLASMA DISPLAY PANEL AND MANUFACTURING METHOD THEREOF

FIELD OF THE INVENTION

The present invention relates to a plasma display panel, and particularly to a direct current plasma display panel with a lower sustained discharge voltage.

BACKGROUND OF THE INVENTION

Conventional direct current plasma display panels (hereinafter referred to as PDP) as shown in FIG. 1, are constructed such that a plurality of anodes A and cathodes K are respectively arranged in an X/Y matrix on the inner surfaces of two parallel substrates 10, 20 and barrier ribs of a certain height for preventing crosstalk are formed between the anodes A. The PDP's anodes A and cathodes K are exposed to the inner space defined by the two substrates and filled with discharge gas, and a DC discharge occurs at each pixel, i.e., the intersection of a cathode K and an anode A, the location of which is selected by a drive voltage momentarily applied to the anode/cathode matrix. When discharge occurs between the anodes and cathodes, discharge light composed of negative glow from the cathodes and positive glow from the anodes is emitted. It is the negative glow which directly contributes to image display.

The conventional direct current PDPs are inefficient in utilizing space because the volume of a barrier rib is much larger than the volume of the discharge space. Therefore, cathodes and anodes become elongated while their width should be limited to a certain degree, which increases their electric resistance. As a result, a voltage drop is created due to the high resistance thereby weakening the discharge intensity between the cathodes and anodes. To solve this problem, the initial discharge voltage and the sustained discharge voltage should be increased by raising the voltage applied across the cathodes and anodes. The voltage drop becomes greater as the distance between where the voltage is applied lengthens. Therefore, image luminance is nonlinear.

SUMMARY OF THE INVENTION

Therefore, it is an object of the present invention to provide a plasma display panel with a low sustained discharge voltage and high current concentration in the cathode.

It is another object of the present invention to provide a plasma display panel which can realize a pictorial image having uniform luminance.

Yet another object of the present invention is to provide a method of manufacturing a plasma display panel according to the instant invention.

To achieve these and other objects, a PDP of the present invention comprises two substrates an a plurality of striped anodes and cathodes arranged in an X/Y matrix on the substrates, wherein the cathodes are formed creating cupped U-shaped sections so that during discharge, negative glow occurs inside the cupped spaces.

A method of manufacturing the PDP is provided wherein a plurality of striped first cathode elements are formed in parallel and at regular intervals on the rear plate. A plurality of insulating walls of a certain height are formed between the first cathode elements. To complete the cathode units second cathode elements are formed on the sides of the insulating walls which are electrically connected to the first cathode elements located between respective neighboring insulating walls.

The PDP of the present invention has far greater discharge efficiency than conventional PDP's because of maximized discharge surface and lowered line resistance of the cathode surfaces and also has added advantages due to hollow cathode discharge as well as lower line resistance of the cathodes. That is, current loss in the cathodes becomes lower and negative glow occurs in the U-shaped spaces formed by the cathodes due to the lowering of the line resistance of the cathodes so that the voltage necessary to maintain plasma discharge becomes lower as compared with conventional PDPs. Therefore, the PDP of the present invention has a much higher concentration of cathode current than the conventional PDPs and realizes a pictorial image of uniform luminance throughout the whole screen.

BRIEF DESCRIPTION OF THE DRAWINGS

The above objects and other advantages of the present invention will become more apparent by describing in detail the preferred embodiments of the present invention with reference to the attached drawings in which.

DETAILED DESCRIPTION

Figure 1:
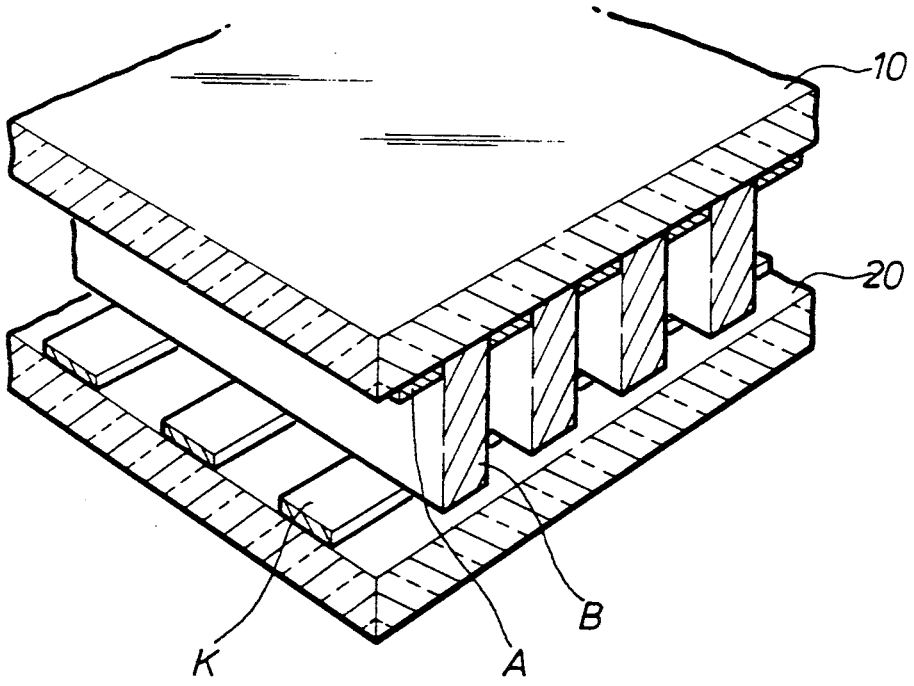
FIG. 1(PRIOR ART)
FIG. 1 is a cutaway perspective view of a conventional PDP.
Figure 2:
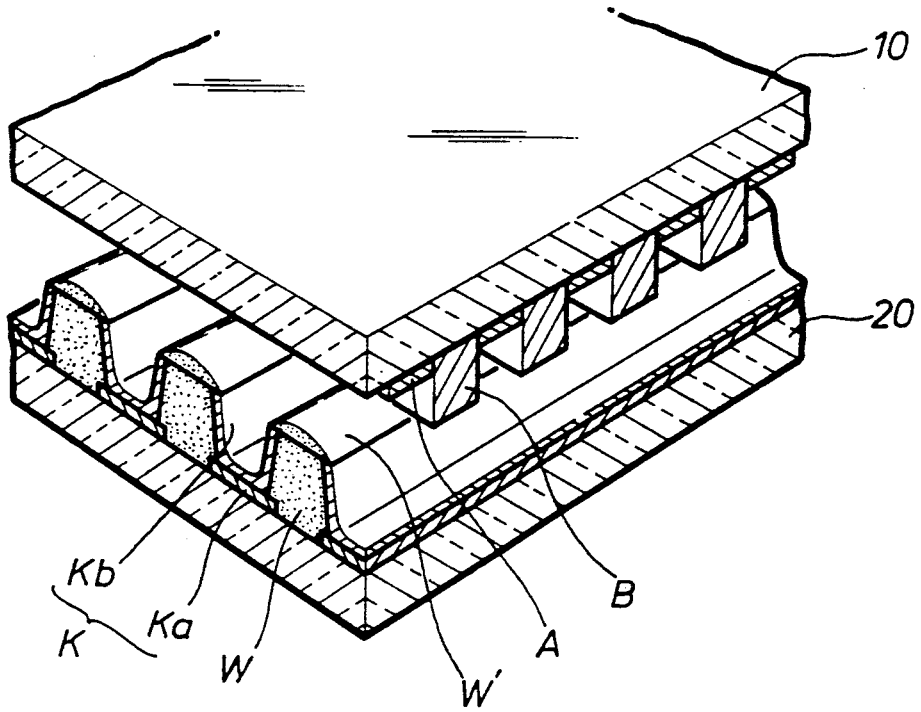
FIG. 2 is a cutaway perspective view of an embodiment of a PDP according to the present invention.
Figure 3:
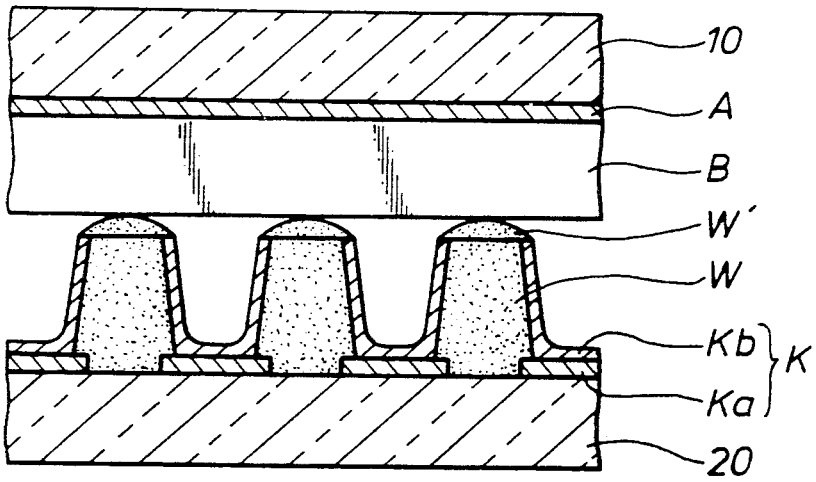
FIG. 3 is a sectional view of the PDP shown in FIG. 2.

Referring to FIGS. 2 and 3, a plurality of anodes A and unit cathodes K are arranged at regular intervals on the face and rear substrates 10 and 20 in an X/Y matrix and barrier ribs B of a certain height are formed between the respective neighboring anodes A. Walls W insulating the unit cathodes K are formed between the respective neighboring anodes on the rear substrate 20 and thin insulating layers W' are stacked on the tops of the walls W extending onto the top edge of cathode unit K. The cathode unit K has a U-shaped cross section which consists of horizontal first cathode elements Ka formed directly on the rear substrate 20 and U-shaped second cathode elements formed on the walls W and whose lower portion makes contact with the first cathode elements Ka. The first cathode element is a highly conductive silver paste and the second cathode element is made of nickel paste having ion bombardment resistance. At this time, the first cathode element should be isolated from the discharge space by the second cathode element and the walls W because the first cathode element made of silver paste, may form amalgam when exposed to mercury within the discharge space.

Figure 4:
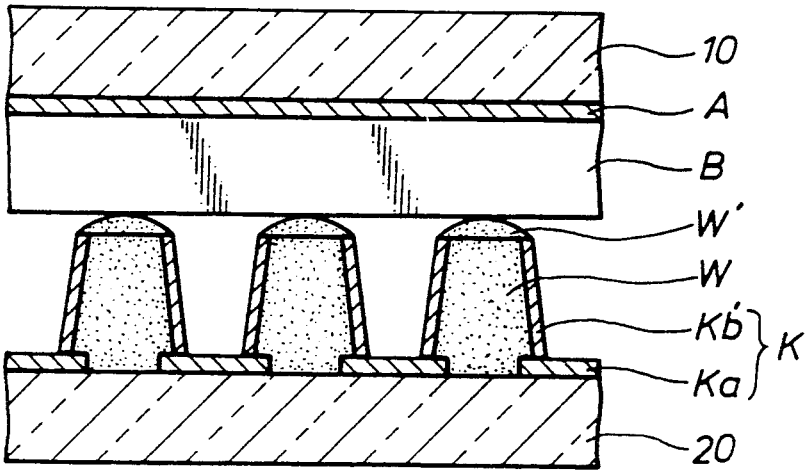
FIG. 4 is a sectional view of another embodiment of a PDP.

FIG. 4 shows another embodiment of the invention in which the unit cathode may be modified. The second cathode elements Kb' are formed on the sides of walls W having their bottom ends overlap and make contact with the first cathode elements Ka. In this case, the first cathode elements cannot be made of silver paste but should be made of some other highly conductive material because the first cathode elements are exposed to the discharge space through the gap between the bottom ends of the corresponding second cathode elements.

In the PDP of the present invention, a cathode consists of two cathode elements Ka and Kb or Ka and Kb' which have U-shaped cross sections forming a hollow cathode which generates the hollow cathode discharge. The hollow cathode encloses the negative glow when discharging plasma so that it has high luminous efficiency due to high secondary electron generating effect. The plasma display panel of the present invention has a lower sustained discharge voltage and a higher concentration of discharge current as compared with the device having planar cathodes.

According to the present invention, a method of fabricating the cathodes and insulating the walls on the bottom substrate is as follows.

Figure 5A:
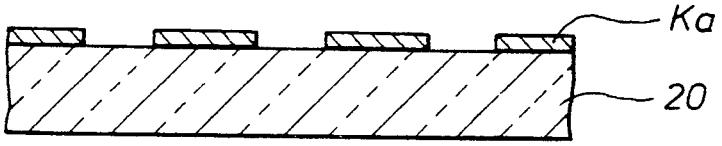
FIGS. 5A to 5E are sectional views for illustrating the manufacturing process of a PDP according to the present invention.
Figure 5B:
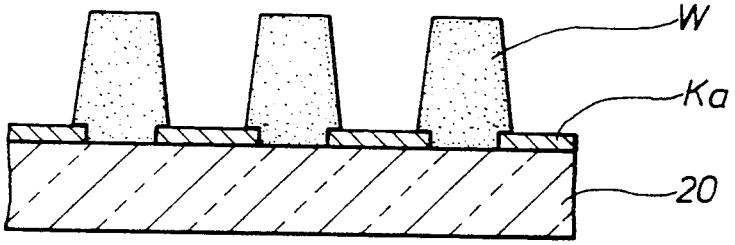
Figure 5C:
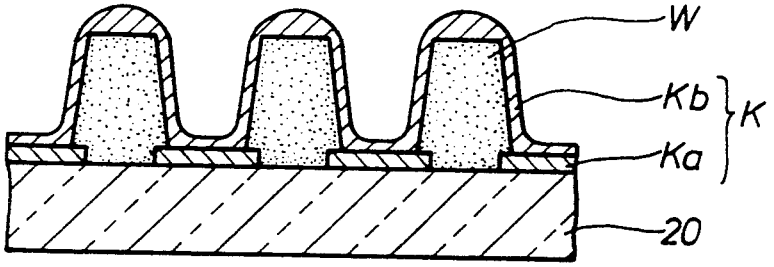
Figure 5D:
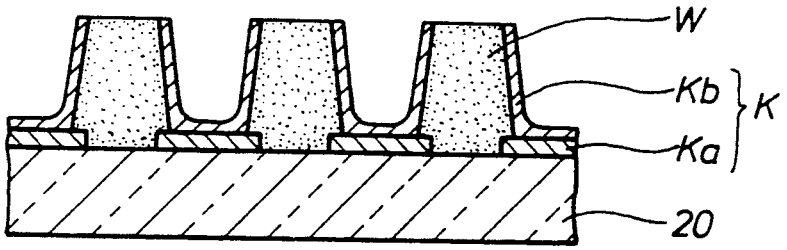
Figure 5E:
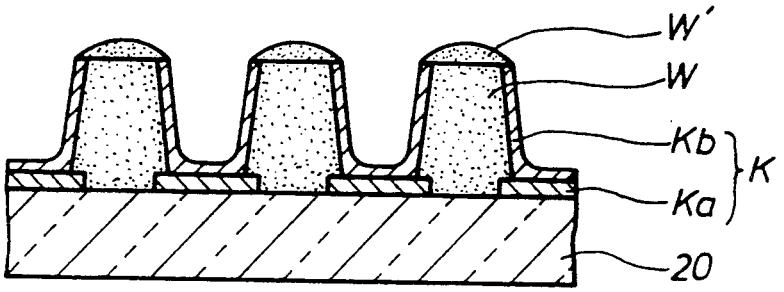

Referring to FIG. 5A, striped first cathode elements Ka are formed on the rear substrate 20 by a conventional method, for instance, silk printing. Material of high conductivity is used for the first cathode elements. Then, as shown in FIG. 5B, insulating walls W of a certain height (about 100 $\mu$m) are formed with glass paste between the first cathode elements Ka. At this time, both sides of the bottoms of the insulating walls W overlap the edges of the first cathode elements Ka. Referring to FIG. 5C, one thin layer forming all of the second cathode elements Kb is deposited over the entire surface of the insulating walls and the first cathode elements Ka. Element Kb is made of a conductive material of antisputtering resist, for instance, nickel paste, replied by deposition, especially chemical vapor deposition (CVD). In process of deposition, a thin layer is evenly formed over the top of the insulating walls W, and thus requires the fabrication of the second cathode elements Kb to be completed by polishing off the thin layer formed on the top of the insulating walls as shown in FIG. 5D. If necessary, an insulating layer W' may be formed on the polished top of the insulating wall W as shown in FIG. 5E.

The above fabricating method is part of the entire process for manufacturing a plasma panel display and the other steps in the process of the present invention are the same as the conventional one.

The plasma display panel of the present invention has been explained with respect to only one simply structured PDP among many intricate plasma display panels to which the invention can be applied. Thus, it is intended that the present invention be applied to plasma display panels of high density and more complicated structure.

What is claimed is:

1. A plasma display panel comprising:

a face substrate and a rear substrate facing and spaced apart from said face substrate by a predetermined distance;

a plurality of striped anodes disposed on said face substrate;

a plurality of cathodes oriented perpendicular to said anodes and disposed on said rear substrate;

each of said cathodes is divided into a striped first cathode element formed on said rear substrate and a U-shaped second cathode element disposed on said first cathode element and having a curved lower end and two vertical upper parts so as to form a cupped space facing said face substrate.

2. A plasma display panel as claimed in claim 1, wherein each of said curved lower ends of said second cathode elements is separated by a certain width.

3. A plasma display panel as claimed in claim 1, wherein the first cathode element is made of a highly conductive material.

4. A plasma display panel as claimed in claim 1, wherein the second cathode element is made of a material that is resistant to ion bombardment.

5. A plasma display device as claimed in claim 1, wherein the first cathode element is made of silver paste.

6. A plasma display device as claimed in claim 1, wherein the second cathode element is made of nickel paste.

7. A plasma display panel as claimed in claim 1 wherein a plurality of walls of a predetermined height are formed between said first cathode elements on the rear substrate, and the vertical upper parts of said second cathode elements are stuck to said walls.

8. A plasma display panel as claimed in claim 7, wherein each of said curved lower ends of said second cathode elements is separated by a certain width.

9. A method of fabricating a plasma display panel which comprises a face substrate, a rear substrate and a plurality of striped anodes and cathodes arranged in an X/Y matrix on said substrates, comprising the steps of:

forming a plurality of striped first cathode elements in parallel and at regular intervals on said rear plate;

forming a plurality of insulating walls of a certain height between said first cathode elements;

completing unit cathodes by forming second cathode elements on the sides of said insulating walls, which are electrically connected to said first cathode elements located between each neighboring insulating wall.

10. A method of fabricating a plasma display panel as claimed in claim 9, wherein electrically independent U-shaped unit cathodes are formed between the insulating walls by forming conductive layers over said first cathode elements and the tops of the walls and insulating the layers from one another.

11. A plasma display panel comprising:

a face substrate and a rear substrate;

a plurality of striped anodes and cathodes formed on said face and rear substrates, respectively, said cathodes divided into first and second cathode elements; and a plurality of walls of predetermined heights disposed between the first cathode elements having sides that are contiguous to the second cathode elements.

12. A plasma display panel as claimed in claim 11, wherein the first cathode element is made of a highly conductive material.

* * * * *